US008424421B1

(12) United States Patent
Woo et al.

(10) Patent No.: US 8,424,421 B1
(45) Date of Patent: Apr. 23, 2013

(54) JOG-SHUTTLE TYPE RATCHET WRENCH

(75) Inventors: Byeong Ok Woo, Ulsan (KR); Jae Soo Kim, Yongin (KR); Kwang-Hak Lee, Ulsan (KR)

(73) Assignee: World Tools Co., Ltd. (KR)

( * ) Notice: Subject to any disclaimer, the term of this patent is extended or adjusted under 35 U.S.C. 154(b) by 0 days.

(21) Appl. No.: 13/459,713

(22) Filed: Apr. 30, 2012

(30) Foreign Application Priority Data

Mar. 26, 2012 (KR) ..... 10-2012-0030810

(51) Int. Cl.
*B25B 13/46* (2006.01)

(52) U.S. Cl.
USPC ..... 81/63; 81/155; 81/60

(58) Field of Classification Search ..... 81/52–186, 81/429–462, 467–483
See application file for complete search history.

(56) References Cited

U.S. PATENT DOCUMENTS 7,721,629 B2 * 5/2010 Shen et al. ..... 81/155
7,765,897 B2 * 8/2010 Kim et al. ..... 81/60

* cited by examiner

*Primary Examiner* — Monica Carter
*Assistant Examiner* — Melanie Alexander
(74) *Attorney, Agent, or Firm* — Harness, Dickey & Pierce, P.L.C.

(57) ABSTRACT

Disclosed therein is a jog-shuttle type ratchet wrench. The jog-shuttle type ratchet wrench includes: a body part having a round hole formed at one side thereof and a stopper embedded therein; a head part rotatably mounted in the round hole; a bevel gear having a first gear portion rotatably joined to one end portion of the control roller inside the housing and a second gear portion rotatably geared with the first gear portion in interlock with the rotation of the first gear portion; a rotary shaft located inside the housing and joined to the second gear portion; and a pair of jaws having an end portion inserted into the housing, wherein the head part is selectively rotated only in one direction when the ratchet gear engages with the stopper.

9 Claims, 7 Drawing Sheets

JOG-SHUTTLE TYPE RATCHET WRENCH

CROSS-REFERENCE TO RELATED APPLICATION

This application is based on and claims priority from Korean Patent Application No. 10-2012-0030810 filed on Mar. 26, 2012 in the Korean Intellectual Property Office, the disclosure of which is incorporated herein in its entirety by reference.

BACKGROUND OF THE INVENTION

1. Field of the Invention

The present invention relates to a jog-shuttle type ratchet wrench, and more particularly, to a jog-shuttle type ratchet wrench, which can continuously assemble or disassemble bolts or nuts of various sizes without using additional socket.

2. Background Art

In general, ratchet wrenches are tools used for easily tightening or releasing bolts or nuts, and are classified in various ways according to their sizes, forms and using methods.

A ratchet wrench having a structure shown in FIG. 1 is generally used, and generally includes: a body 10; a head part 20 mounted on one side of the body 10 and having a ratchet gear formed on an outer rim thereof; a hand-grip part 30 mounted on the other side of the body 10; and a socket 40 fit to the head part 20 and having a recess to which a bolt or a nut head is fit.

In the case that a user wants to assemble or disassemble bolts or nuts using the ratchet wrench, when the user rotates the hand-grip part 30 in a clockwise or counterclockwise direction at a predetermined angle, the head part 20 and the socket 40 are rotated and a bolt head 50 inserted into the socket 40 is rotated, and thereby, the bolt is tightened or released.

However, because the socket of the conventional ratchet wrench can be used only in the case that a bolt of a single size is assembled or disassembled, there is a problem in that sockets of different sizes according to sizes of bolts must be separately joined to the head part in the case that bolts of different sizes are assembled or disassembled.

That is, in the case that bolts of different sizes are assembled or disassembled, after one bolt is assembled or disassembled using the ratchet wrench, the socket must be detached from the head part, and hence, the sockets of different sizes must be joined or detached whenever bolts or other fasteners of different sizes are used.

Moreover, the conventional ratchet wrench has other problems in that the ratchet wrench costs high and the user have to carry a heavy tool box because sockets of different sizes must be prepared, and in that it is difficult to assemble or disassemble bolts or nuts into deep holes of objects.

Furthermore, the conventional ratchet wrench has another problem in that it is difficult to assemble or disassemble bolts having a slotted head, a Phillips head, a socket head, a torx head and others, hex bolts, wrench bolts, and square bolts and in that it requires additional drivers, sockets, and wrenches.

SUMMARY OF THE INVENTION

Accordingly, the present invention has been made to solve the above-mentioned problems occurring in the prior arts, and it is an object of the present invention to provide a jog-shuttle type ratchet wrench, which has a simple structure using a bevel gear and includes a pair of jaws mounted on a head part, thereby enhancing work efficiency as being adjusted according to sizes of bolt heads and reducing costs because it does not need a tool box.

It is another object of the present invention to provide a jog-shuttle type ratchet wrench, which includes a space portion formed inside a body part and accommodates driver pieces of various shapes inside the space portion, thereby easily assembling and disassembling bolts having a slotted head, a Phillips head, a socket head, a torx head and others, hex bolts, wrench bolts, and square bolts without using additional driver, socket or wrench.

To accomplish the above object, according to the present invention, there is provided a jog-shuttle type ratchet wrench including: a body part having a round hole formed at one side thereof and a stopper embedded therein; a head part rotatably mounted in the round hole, the head part having a housing, which has a control roller disposed at one side of an upper face thereof, and a ratchet gear formed on the outer face of the housing; a bevel gear having a first gear portion rotatably joined to one end portion of the control roller inside the housing and a second gear portion rotatably geared with the first gear portion in interlock with the rotation of the first gear portion; a rotary shaft located inside the housing and joined to the second gear portion in such a way as to rotate in interlock with the rotation of the second gear portion; and a pair of jaws having an end portion inserted into the housing, the jaws respectively being screw-coupled to the outer circumferential surface of the rotary shaft so as to be slidably moved along a longitudinal direction of the rotary shaft, wherein the head part is selectively rotated only in one direction when the ratchet gear engages with the stopper.

The stopper is formed in a triangular shape, and includes: sawteeth formed at both ends of one side of the stopper in such a way as to engage with the ratchet gear; and a pair of arc-curved portions formed adjacent with each other at the other side of the stopper in such a way as to get in contact with a ball of a ball plunger disposed at one side of the stopper.

The housing is formed in a cylindrical shape having an inner space, and includes: a mounting recess formed in the upper face thereof for mounting the control roller therein; and a housing cover joined to the lower face thereof and having a jaw guide groove for guiding a slide of the jaws.

The rotary shaft includes spiral threads formed symmetrically relative to the central portion thereof so that the jaws are slidably moved in opposite directions according to the rotation of the rotary shaft.

A hand-grip is joined to the outer face of the body part, and an adapter detachably joined to the lower end portions of the jaws is disposed at one end portion of the hand-grip.

The adapter includes: a jaw-joining portion having a jaw-joining recess formed inside the jaw-joining portion; and a socket-joining portion protrudingly formed at the lower portion of the jaw-joining portion.

The socket-joining portion includes a driver piece hole, which is formed inside the body part, and, to which a driver piece accommodated in the space portion formed along the longitudinal direction is joined.

The jaw-joining portion includes: a retaining groove formed in a predetermined position of the outer circumferential surface of the jaw-joining portion in the circumferential direction; and a retaining projection formed at a predetermined position of the inner circumferential surface of one end portion of the hand-grip in such a fashion that the retaining groove is retained and joined to the retaining projection.

A ball plunger for joining a wrench socket is disposed at one side of the jaw-joining portion.

According to the present invention having the above structure, because the jog-shuttle type ratchet wrench has a simple structure using the bevel gear and includes a pair of the jaws mounted on the head part, the ratchet wrench can enhance work efficiency as being adjusted according to sizes of bolt heads and reduce costs because it does not need a tool box.

Furthermore, the jog-shuttle type ratchet wrench can easily assemble and disassemble wrench bolts or no-headed wrench bolts having a slotted head, a Phillips head, a socket head, a torx head and others without using additional driver wrench because the ratchet wrench includes the space portion formed inside the body part and accommodates driver pieces of various shapes inside the space portion.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
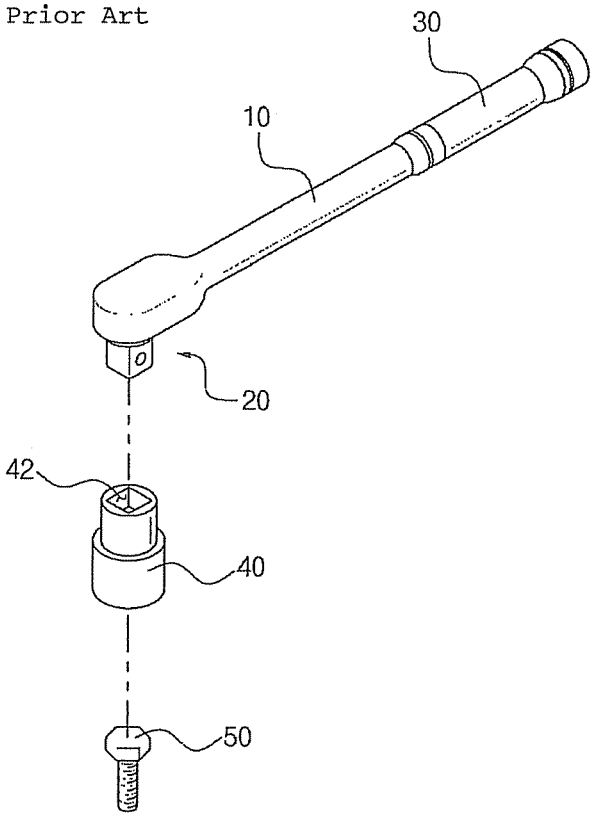
FIG. 1 Prior Art
FIG. 1 is a perspective view showing a ratchet wrench according to a prior art.

Hereinafter, reference will be now made in detail to the preferred embodiments of the present invention with reference to the attached drawings. It will be understood that thickness of lines or sizes of components in the drawings would be illustrated exaggeratedly for convenience sake and for clarity in description.

Additionally, it will be understood that words or terms used in the specification and claims are defined in consideration of functions of the present invention and hence may be changed according to users' intentions or according to practices. Accordingly, it will be further understood that the words or terms should be defined based on the contents of the whole specification of the present invention.

Figure 2:
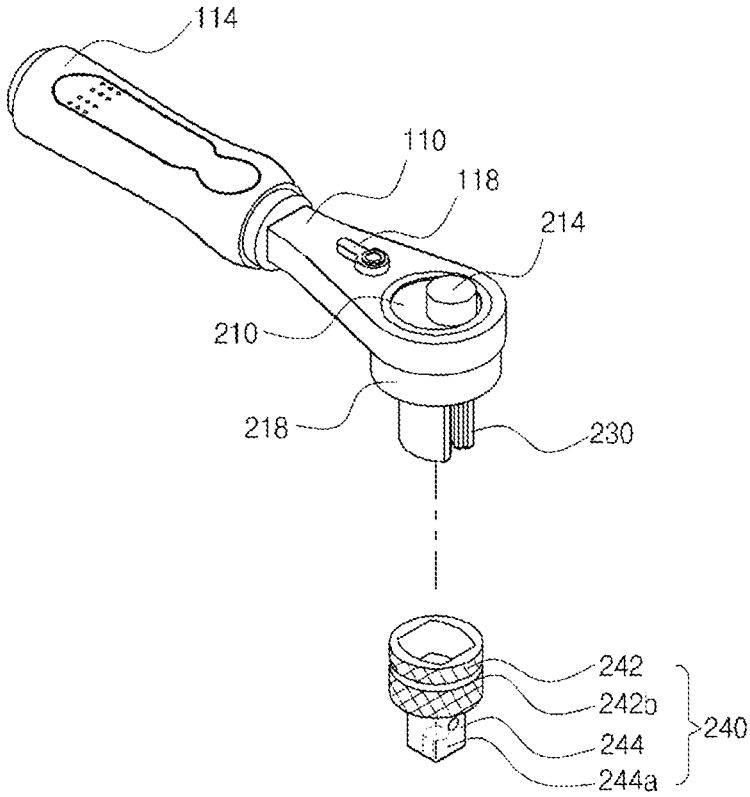
FIGS. 2 and 3 are perspective views of a jog-shuttle type ratchet wrench according to a preferred embodiment of the present invention.
Figure 3:
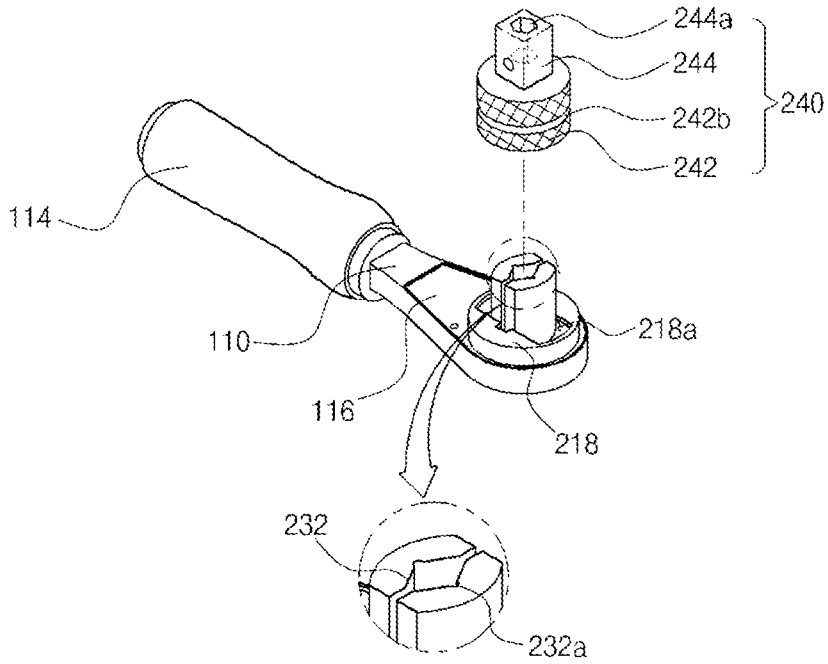
Figure 4:
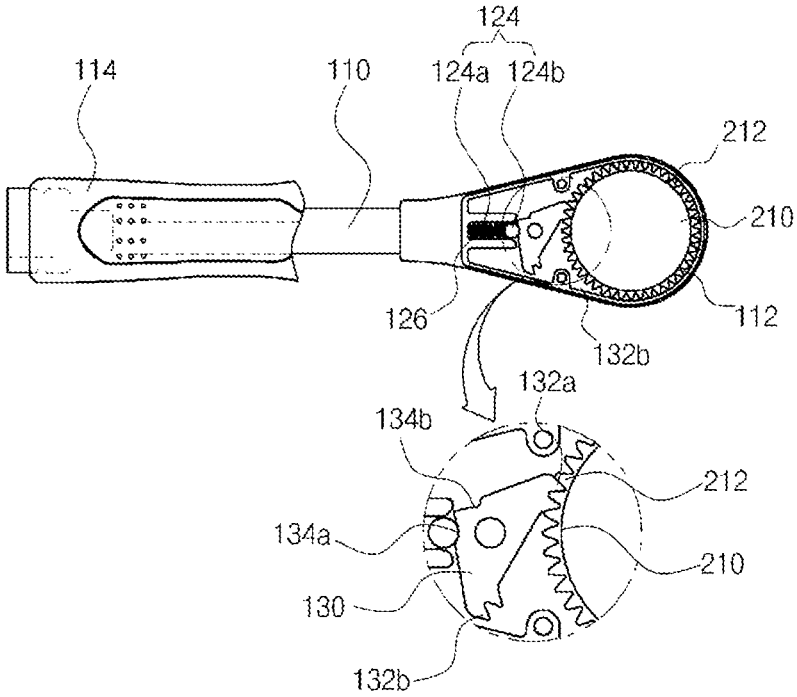
FIG. 4 is a plan sectional view of the jog-shuttle type ratchet wrench according to the preferred embodiment of the present invention.
Figure 5:
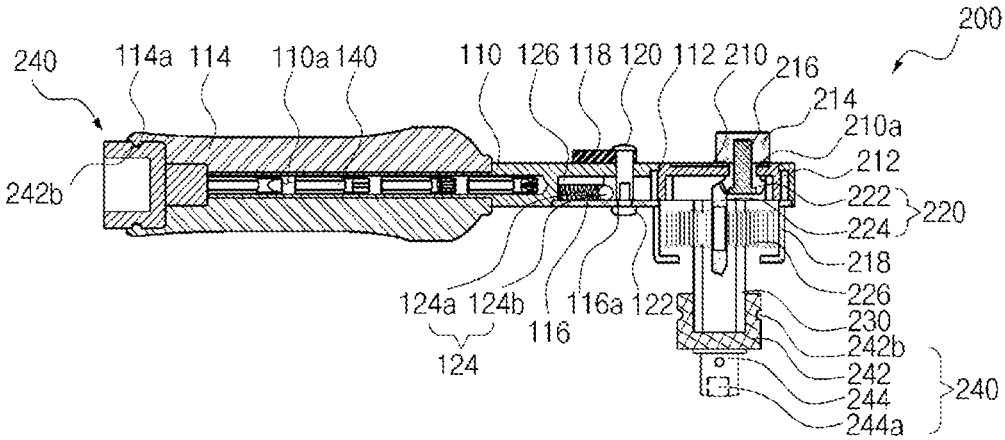
FIG. 5 is cross-sectional view of the jog-shuttle type ratchet wrench
Figure 6:
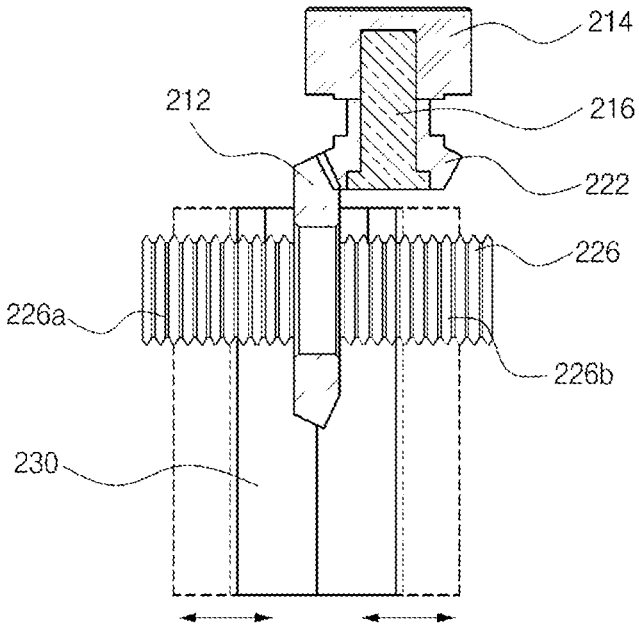
FIG. 6 is a view showing operational states of a control roller, a bevel gear and a jaw according to the preferred embodiment of the present invention.
Figure 7A:
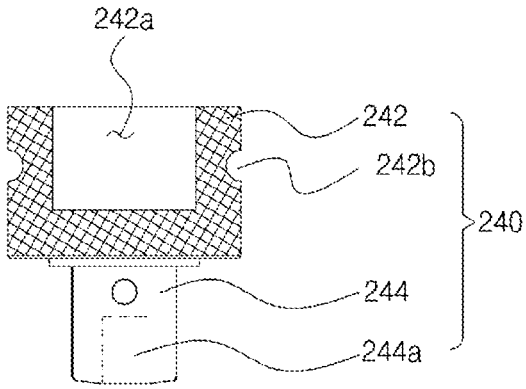
FIGS. 7*a* and 7*b* are schematic views of an adapter according to the preferred embodiment of the present invention.
Figure 7B:
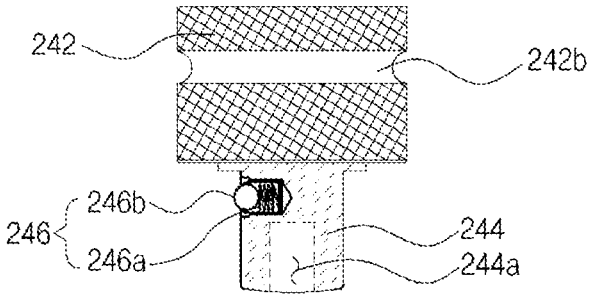
Figure 8A:
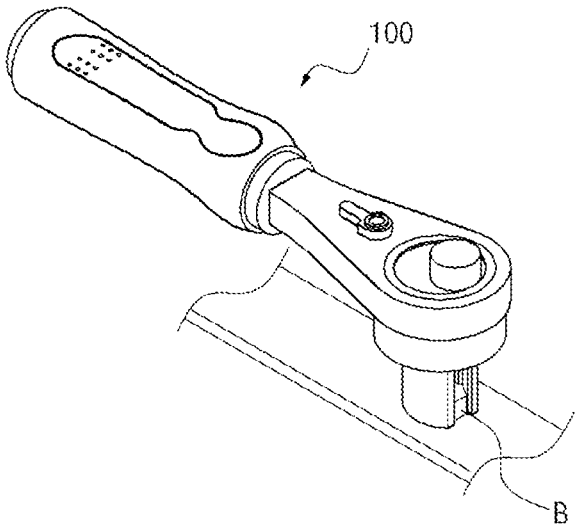
FIGS. 8*a* and 8*b* are views showing a used state of the jog-shuttle type ratchet wrench according to the preferred embodiment of the present invention.
Figure 8B:
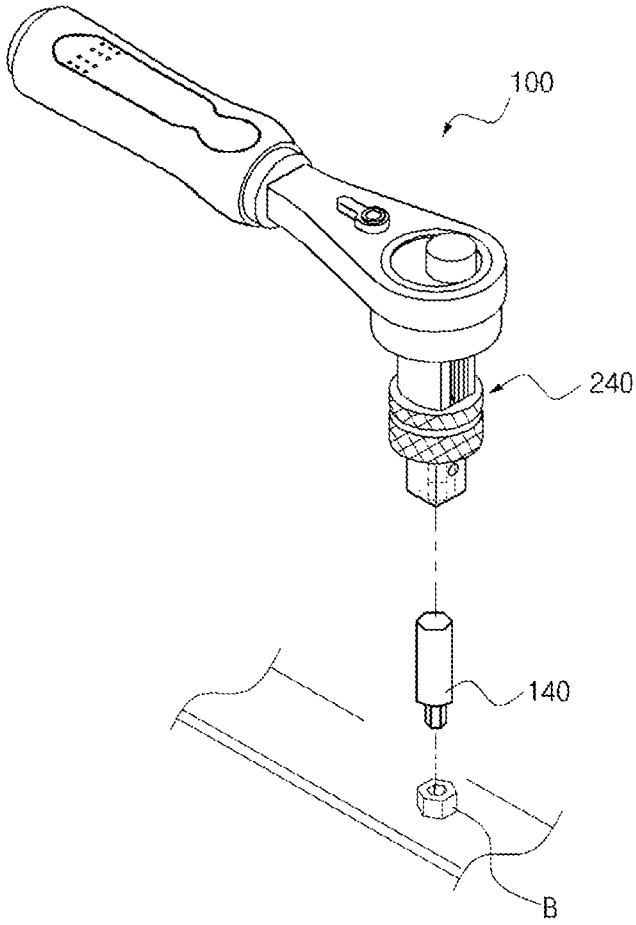

FIGS. 2 and 3 are perspective views of a jog-shuttle type ratchet wrench according to a preferred embodiment of the present invention, FIG. 4 is a plan sectional view of the jog-shuttle type ratchet wrench, FIG. 5 is cross-sectional view of the jog-shuttle type ratchet wrench, FIG. 6 is a view showing operational states of a control roller, a bevel gear and a jaw according to the preferred embodiment of the present invention, FIGS. 7*a* and 7*b* are schematic views of an adapter according to the preferred embodiment of the present invention, and FIGS. 8*a* and 8*b* are views showing a used state of the jog-shuttle type ratchet wrench according to the preferred embodiment of the present invention.

Referring to FIGS. 2 to 8, a jog-shuttle type ratchet wrench 100 according to the preferred embodiment of the present invention includes a body part 110, a head part 200, a bevel gear 220, a rotary shaft 226, and a pair of jaws 230.

The body part 110 includes a round hole 112 formed at one side thereof and a hand-grip 114 extending long at the other side thereof.

The body part 110 further includes a space portion 110*a* formed inside the body part 110 in a longitudinal direction and a plurality of driver pieces 140 accommodated in the space portion 110*a*.

The driver piece 140 is joined to a driver piece hole 244*a* formed in a socket joining portion 244 of an adapter 240, which will be described later. It is preferable that the driver piece 140 has an end portion having one of various shapes, such as a slotted shape, a cross shape, a hexagonal shape, a star shape, and so on, at one end portion thereof and the other end portion having a shape corresponding to the driver piece hole 244*a* so as to be joined with the driver piece hole 244*a*.

Here, it is preferable that the hand-grip 114 is made of rubber, silicon, or synthetic resin so as to allow a user to easily grasp the ratchet wrench and to prevent a slip.

Moreover, a cover 116 for supporting a housing 210 and a ball plunger 124, which will be described later, is detachably joined to one side of a lower portion of the body part 110.

The cover 116 includes a cover hole 116*a* to which a lever screw 122 is inserted, and the lever screw 122 rotatably fixes a lever pin 120, which penetrates into the lever screw 122 and connects a stopper 130 and a control lever 118.

The control lever 118 is mounted at one side of the outer face of the body part 110 by the lever pin 120, and functions to selectively rotate the stopper 130 in one direction.

The stopper 130 is mounted inside the body part 110, and is joined with the ratchet gear 212 of the head part 200 so as to control the head part 200 to rotate in one direction.

The stopper 130 is penetratedly joined to the lever pin 120 so as to interlock with the action of the control lever 118.

Here, the stopper 130 is formed in a triangular shape, and includes sawteeth 132*a* and 132*b* formed at both ends of one side thereof and engaging the ratchet gear 212 and a pair of arc-curved portions 134*a* and 134*b* formed adjacent with each other at the other side thereof and having a curvature to get in contact with a ball 124*b* of the ball plunger 124 disposed at one side of the stopper 130.

The ball plunger 124 includes an elastic spring 124*a* and the ball 124*b*, and operates in such a fashion that the ball 124*b* applies power in one direction by elasticity of the elastic spring 124*a*.

The elastic spring 124*a* is seated on a spring insertion hole 126 of the body part 110 and its one end is fixed to the body part 110. The ball 124*b* is mounted between the other end of the elastic spring 124*a* and the stopper 130 so as to transfer elasticity of the elastic spring 124*a* to the stopper 130.

The sawteeth 132*a* and 132*b* are respectively caught to the ratchet gear 212 in one direction and are inclined at an predetermined angle outwardly from the central portion of the stopper 130 in the opposite direction so that the sawteeth 132*a* and 132*b* can run over the ratchet gear 212.

Accordingly, referring to FIG. 4, when the body part 110 is rotated in the clockwise direction, the stopper 130 mounted on the body part 110 is also rotated, and in this instance, because the sawteeth 132*a* of the stopper 130 is caught to the ratchet gear 212, the stopper 130 transfers a rotational force to the ratchet gear 212, and then, the housing 210 mounted in the round hole 112 of the body part 110 can be rotated together with the body part 110.

On the contrary, when the body part 110 is rotated in the counterclockwise direction, because the sawteeth 132*a* of the stopper 130 run over the ratchet gear 212, the rotational force is not transferred to the housing 210, and hence, only the body part 110 is rotated with no rotation of the housing 210.

The head part 200 includes the housing 210, the ratchet gear 212, the bevel gear 220, and a pair of the jaws 230.

The housing 210 is in a cylindrical form having a space therein, rotatably penetrates into the round hole 112 of the body part 110, and has the ratchet gear 212 formed on the outer face thereof.

The housing 210 includes: a mounting recess 210*a* formed at one side of the upper face thereof in such a fashion that the control roller 214 is mounted by a gear shaft 216; and a housing cover 218 joined to the lower face thereof and having a jaw guide groove 218*a* for guiding a slide of the jaws 230.

The bevel gear 220 includes: a first gear portion 222 rotatably joined to one end portion of the control roller 214 through the gear shaft 216 inside the housing 210; and a second gear portion 224 rotatably geared with the first gear portion 222 in interlock with the first gear portion 222.

That is, the first gear portion 222 is joined to the control roller 214 by the gear shaft 216 and located inside the housing 210 in such a way as to be rotated in a horizontal direction, and the second gear portion 224 is geared with the first gear portion 222 and located inside the housing 210 in such a way as to be rotated in a vertical direction.

Furthermore, the rotary shaft 226, which interlocks with the second gear portion 224, is joined to the second gear portion 224, and has spiral threads 226*a* and 226*b* formed symmetrically relative to the central portion of the rotary shaft 226. In more detail, the left-side spiral thread 226*a* relative to the central portion of the rotary shaft 226 is inclined somewhat to the left by left-handed screw machining and the right-side spiral thread 226*b* is inclined somewhat to the right by right-handed screw machining.

Therefore, a pair of the jaws 230 respectively joined to the outer circumferential surfaces of both sides of the rotary shaft 226 are slidably moved in opposite directions to each other according to the rotation of the rotary shaft 226.

Because the bevel gear 220 is rotated by a rotational manipulation of the control roller 214, the rotary shaft 226 joined to the second gear portion 224 is also rotated, so that a distance between the jaws 230 can be adjusted according to the rotation of the rotary shaft 226.

One end of each jaw 230 is inserted into the housing 210 and the other end is screw-coupled to the outer circumference of the rotary shaft 226 in such a way as to be slidably moved in a longitudinal direction of the rotary shaft 226.

The opposed faces of the jaws 230, namely, the faces which are in contact with the bolt head, respectively have V-shaped retaining holes 232, and edge portions where outer sides of the bolt head meet are inserted into the V-shaped retaining holes 232.

Here, in the case that the outer edge portions of the bolt head are in contact with the retaining holes 232, because the edge portions of the bolt head may be worn or damaged due to friction generated during the assembling or disassembling process of the bolt, it is preferable that the retaining holes 232 respectively have round holes 232*a*.

In addition, the adapter 240 for attaching or detaching a wrench socket is detachably joined to lower end portions of the jaws 230, namely, at one end portion of the hand-grip 114.

Moreover, the adapter 240 includes a jaw-joining portion 242, which is formed at one side of the adapter 240 and detachably joined to the jaws 230, and a socket-joining portion 244, which is protrudingly formed at the other side of the adapter 240, and to which the wrench socket is detachably joined.

The jaw-joining portion 242 includes a round jaw-joining recess 242*a* formed inside the jaw-joining portion 242 such that a pair of the jaws 230 are inserted and joined into the jaw-joining recess 242*a*.

Furthermore, the jaw-joining portion 242 further includes a retaining groove 242*b* formed along the circumference of the outer face thereof, and the retaining groove 242*b* is retained and joined to a retaining projection 114*a* formed at a predetermined position of the inner face of the hand-grip 114.

Additionally, it is preferable that the jaw-joining portion 242 has a knurled outer surface for preventing a slip.

The socket-joining portion 244 has the driver piece hole 244*a*, which is formed inside the socket-joining portion 244, and, to which the driver piece 140 accommodated in the space portion 110*a* formed inside the body part 110 along the longitudinal direction is joined.

In addition, the ball plunger 246 having the ball 246*b* and the spring 246*a* is inserted and fixed into one side of the socket-joining portion 244.

Hereinafter, a process of assembling or disassembling the bolt using the jog-shuttle type ratchet wrench according to the preferred embodiment of the present invention will be described.

In order to assemble the bolt, first, when the control lever 118 is rotated, the sawteeth 132*a*, which are in assembly, out of the sawteeth 132*a* and 132*b* formed at both sides of the stopper 130 of the body part 110 engage the ratchet gear 212 formed on the outer face of the housing 210.

After that, when the control roller 214 mounted at one side of the upper face of the housing 210 is rotated in the clockwise direction or in the counterclockwise direction, the first gear portion 222 of the bevel gear 220 connected with the control roller 214 through the gear shaft 216 is rotated, and then, the second gear portion 224 rotatably geared with the first gear portion 22 in interlock with the first gear portion 222 is also rotated.

When the second gear portion 224 is rotated, the rotary shaft 226 joined to the second gear portion 224 is rotated, so that the distance between a pair of the jaws 230 respectively joined to the outer circumferences of both sides of the rotary shaft 226 gets narrower or wider and the jaws 230 press and fix the right and left of the bolt head.

After that, when the hand-grip 114 is rotated in the clockwise direction in the drawings, the stopper 130 pushes the ratchet gear 212, and hence, the head part 200 is rotated in the clockwise direction.

Accordingly, the bolt fixed to the jaws 230 is rotated in the clockwise direction when the head part 200 is rotated in the clockwise direction. After the body part 110 and the head part 200 are rotated at predetermined angles, when the hand-grip 114 is rotated in the counterclockwise direction, the body part 110 is returned to its original position. After that, if the above process of rotating the hand-grip 114 in the clockwise direction is repeated, the assembly of the bolt is finished.

In the meantime, in order to disassemble the bolt, when the control lever 118 is rotated in the counterclockwise direction in the drawings, the sawteeth 132*b*, which are in disassembly, out of the sawteeth 132*a* and 132*b* formed at both ends of the stopper 130 mounted inside the body part 110 are joined with the ratchet gear 212.

After that, when the hand-grip 114 is rotated in the counterclockwise direction in the drawings to rotate the body part 110 in the counterclockwise direction, the sawteeth 132*b* of the stopper 130 push the ratchet gear 212, and thereby, the head part 200 is rotated in the counterclockwise direction.

Accordingly, when the head part 200 is rotated in the counterclockwise direction, the bolt fixed to the jaws 230 is rotated in the counterclockwise direction, and then, is disassembled. Also in this instance, after the body part 110 and the head part 200 are rotated at the predetermined angle, when the hand-grip 114 is rotated in the clockwise direction, the body part 110 is returned to its original position. After that, when the process of rotating the hand-grip 114 in the counterclockwise direction is repeated, the disassembly of the bolt is finished.

Moreover, in order to assemble into or disassemble from a deep hole of an object, the adapter 240 is joined to the lower end portion of the jaws 230 so as to use the conventional socket 40 shown in FIG. 1.

In other words, in order to join the socket 40, when the control roller 214 is rotated and the bevel gear 220 is also rotated, the rotary shaft 226 is rotated, so that the opposed faces of the jaws 230 get in contact with each other. After that, the jaws 230 are inserted and joined into the jaw-joining recess 242*a* of the adapter 240.

After that, when the socket-joining portion 244 is inserted into a socket hole 42 of the socket 40 to be used, the ball plunger 246 disposed at one side of the socket-joining portion 244 is inserted and fixed into a plunger hole (not shown) disposed inside the socket hole 42, and then, the process of joining the socket 40 to the adapter 240 is finished, and hence, the bolt can be assembled or disassembled.

Here, the ball plunger 246 includes the spring 246*a* and the ball 246*b*.

Moreover, driver pieces 140 of various types may be joined to the adapter 240, and in this instance, a plurality of the driver pieces 140 accommodated in the space portion 110*a* of the body part 110 are joined to the driver piece hole 244*a* formed in the socket-joining portion 244 of the adapter 240, and then, a bolt having a slotted head, a Phillips head, a socket head, a torx head or other-shaped head, a hex bolt, a wrench bolt, or a square bolt can be assembled or disassembled to the head part.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A jog-shuttle type ratchet wrench comprising:

a body part having a round hole formed at one side thereof and a stopper embedded therein;

a head part rotatably mounted in the round hole, the head part having a housing, which has a control roller disposed at one side of an upper face thereof, and a ratchet gear formed on the outer face of the housing;

a bevel gear having a first gear portion rotatably joined to one end portion of the control roller inside the housing and a second gear portion rotatably geared with the first gear portion in interlock with the rotation of the first gear portion;

a rotary shaft located inside the housing and joined to the second gear portion in such a way as to rotate in interlock with the rotation of the second gear portion; and a pair of jaws having an end portion inserted into the housing, the jaws respectively being screw-coupled to the outer circumferential surface of the rotary shaft so as to be slidably moved along a longitudinal direction of the rotary shaft, wherein the head part is selectively rotated only in one direction when the ratchet gear engages with the stopper.

2. The jog-shuttle type ratchet wrench according to claim 1, wherein the stopper is formed in a triangular shape, and comprises: sawteeth formed at both ends of one side of the stopper in such a way as to engage with the ratchet gear; and a pair of arc-curved portions formed adjacent with each other at the other side of the stopper in such a way as to get in contact with a ball of a ball plunger disposed at one side of the stopper.

3. The jog-shuttle type ratchet wrench according to claim 1, wherein the housing is formed in a cylindrical shape having an inner space, and comprises: a mounting recess formed in the upper face thereof for mounting the control roller therein; and a housing cover joined to the lower face thereof and having a jaw guide groove for guiding a slide of the jaws.

4. The jog-shuttle type ratchet wrench according to claim 1, wherein the rotary shaft comprises spiral threads formed symmetrically relative to the central portion thereof so that the jaws are slidably moved in opposite directions according to the rotation of the rotary shaft.

5. The jog-shuttle type ratchet wrench according to claim 1, wherein a hand-grip is joined to the outer face of the body part, and an adapter detachably joined to the lower end portions of the jaws is disposed at one end portion of the hand-grip.

6. The jog-shuttle type ratchet wrench according to claim 5, wherein the adapter comprises: a jaw-joining portion having a jaw-joining recess formed inside the jaw-joining portion; and a socket-joining portion protrudingly formed at the lower portion of the jaw-joining portion.

7. The jog-shuttle type ratchet wrench according to claim 6, wherein the socket-joining portion comprises a driver piece hole, which is formed inside the body part, and, to which a driver piece accommodated in the space portion formed along the longitudinal direction inside the body part is joined.

8. The jog-shuttle type ratchet wrench according to claim 6, wherein the jaw-joining portion comprises: a retaining groove formed in a predetermined position of the outer circumferential surface of the jaw-joining portion in the circumferential direction; and a retaining projection formed at a predetermined position of the inner circumferential surface of one end portion of the hand-grip in such a fashion that the retaining groove is retained and joined to the retaining projection.

9. The jog-shuttle type ratchet wrench according to claim 6, wherein a ball plunger for joining a wrench socket is disposed at one side of the jaw-joining portion.

* * * * *